US010488001B2

(12) United States Patent
Sonneman et al.

(10) Patent No.: US 10,488,001 B2
(45) Date of Patent: Nov. 26, 2019

(54) LIGHTING SYSTEM

(71) Applicant: Contemporary Visions, LLC, Larchmont, NY (US)

(72) Inventors: Robert A. Sonneman, Mamaroneck, NY (US); Christian N. Garnett, Mount Kisco, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 16/202,419

(22) Filed: Nov. 28, 2018

(65) Prior Publication Data

US 2019/0162376 A1 May 30, 2019

Related U.S. Application Data

(60) Provisional application No. 62/591,420, filed on Nov. 28, 2017, provisional application No. 62/591,426, filed on Nov. 28, 2017.

(51) Int. Cl.
*F21S 8/06* (2006.01)
*F21V 15/01* (2006.01)
(Continued)

(52) U.S. Cl.
CPC ..... *F21S 8/061* (2013.01); *F21S 8/036* (2013.01); *F21V 15/01* (2013.01); *F21V 21/16* (2013.01);
(Continued)

(58) Field of Classification Search
CPC .... F21S 8/06; F21S 8/061; F21S 8/063; F21S 8/065; F21S 8/066; F21S 8/068;
(Continued)

(56) References Cited

U.S. PATENT DOCUMENTS 5,343,375 A 9/1994 Chou et al.
2006/0274531 A1* 12/2006 Kopf ..... F21K 9/00 362/294
(Continued)

FOREIGN PATENT DOCUMENTS

DE 202016101438 U1 * 3/2016 ..... F21V 21/005
WO WO-2017129506 A1 * 8/2017 ..... F21S 6/008

OTHER PUBLICATIONS

Machine translation of DE 202016101438 U1 retrieved from ESPACENET. (Year: 2019).*
ISA/US, PCT International Search Report and Written Opinion dated Feb. 4, 2019 issued in PCT Application No. PCT/US2018/062732 filed Nov. 28, 2018.
USPTO, PCT International Search Report and Written Opinion issued in PCT International Application No. PCT/US2018/062732 dated Feb. 4, 2019.
(Continued)

*Primary Examiner* — Bryon T Gyllstrom
*Assistant Examiner* — Colin J Cattanach
(74) *Attorney, Agent, or Firm* — Gottlieb, Rackman & Reisman, P.C.

(57) ABSTRACT

A lighting system that can be mounted to a structure and provides light in multiple direction, such as both the upward and downward directions. The lighting system can include at least one casing, a plate, a housing, at least one first light source and at least one second light source. The plate can have at least one aperture sized to accept a casing and the housing can have at least one aperture aligned with the aperture of the plate when the plate is arranged on the housing. The first light source can be positioned below the plate and configured to emit light upward and illuminates the casing and the second light source can be arranged within the housing and configured to emit light in a downward direction.

42 Claims, 16 Drawing Sheets

(51) Int. Cl.

| | |
|---|---|
| ***F21S 8/00*** | (2006.01) |
| ***F21V 21/16*** | (2006.01) |
| ***F21V 23/02*** | (2006.01) |
| ***F21V 23/00*** | (2015.01) |
| ***F21Y 115/10*** | (2016.01) |
| ***F21Y 103/10*** | (2016.01) |
| ***F21Y 107/90*** | (2016.01) |

(52) U.S. Cl.
CPC ..... *F21V 23/02* (2013.01); *F21S 8/06* (2013.01); *F21S 8/068* (2013.01); *F21V 23/003* (2013.01); *F21Y 2103/10* (2016.08); *F21Y 2107/90* (2016.08); *F21Y 2115/10* (2016.08)

(58) Field of Classification Search
CPC ..... F21S 2/00; F21S 2/005; F21V 19/0035; F21V 19/0045; F21V 19/0055; F21V 7/0008; F21V 7/0016; F21V 15/01; F21V 15/02; F21Y 2107/90; F21Y 2115/10; F21Y 2103/10
See application file for complete search history.

(56) References Cited

U.S. PATENT DOCUMENTS

| | | | | |
|---|---|---|---|---|
| 2007/0247842 | A1 | 10/2007 | Zampini et al. | |
| 2010/0080003 | A1* | 4/2010 | Lee | F21K 9/00 362/294 |
| 2011/0075416 | A1 | 3/2011 | Chou et al. | |
| 2011/0310614 | A1* | 12/2011 | Budike, Jr. | F21S 4/20 362/294 |
| 2013/0058075 | A1* | 3/2013 | Wang | F21V 3/02 362/147 |
| 2014/0104829 | A1 | 4/2014 | Kuhn et al. | |
| 2015/0345743 | A1 | 12/2015 | Trincia et al. | |
| 2015/0373806 | A1* | 12/2015 | Vissenberg | H05B 33/0872 315/151 |

* cited by examiner

LIGHTING SYSTEM

CROSS-REFERENCE TO RELATED APPLICATIONS

This application claims priority to U.S. Provisional Patent Application No. 62/591,420, filed on Nov. 28, 2017, and U.S. Provisional Patent Application No. 62/591,426, filed on Nov. 28, 2017, the contents of each are incorporated herein by reference in their entireties.

FIELD OF THE INVENTION

This invention relates generally to a luminaire and more specifically to a lighting fixture or lighting system that is configured to be mountable or hung from a surface (e.g., a wall or similar structure or a ceiling or similar structure) and that is configured to emit light in multiple directions, such as an upward direction and a downward direction. The lighting system allows for multiple configurations or orientations depending on the application thereof and the number of lights or casings desired.

BACKGROUND OF THE INVENTION

Sconce type light fixtures are popular and come in various shapes and configurations ranging from a single light fixture to multiple light fixtures that are affixable to a surface (e.g., a wall or ceiling). For surface mountable light fixtures, many times two light fixtures are mounted to a wall in close proximity to each other, for example, to provide ample light in a space, enhance the aesthetics of a space and/or to frame a picture or mirror hanging on a wall. In general, whether a light fixture is mounted to wall or hung from a ceiling, sconce light fixtures generally provide illumination in one general direction, and are commonly chosen based upon the aesthetics of sconce, the amount of lighting desired and the location of where the sconce will be mounted.

SUMMARY OF THE INVENTION

In general, the present disclosure is directed to a luminaire configured to provide light in multiple directions. More specifically, the luminaire is a lighting system that is designed to emit light both in an upward direction and a downward direction. In an embodiment, this can allow for light to be projected upwardly and more focused light to be projected downwardly, below the lighting fixture.

According to an exemplary embodiment, the present disclosure is directed to a lighting system that comprises a housing that is one of mountable to a surface and hung from a surface and that includes at least one aperture extending therethrough, a plate that includes at least one aperture that extends therethrough and that is attachable to the housing, at least one casing that is configured to contact the plate and encompass the at least one aperture of the plate, at least one first light source that is arranged within the housing and that is configured to emit light in an upward direction, through the at least one aperture of the plate and into an internal area of the at least one casing and at least one second light source that is arranged within the housing and that is configured to emit light in a downward direction, through the at least one aperture of the housing.

The housing can includes a plurality of apertures that extend therethrough and that are linearly spaced from each other and the plate can include a plurality of apertures that extend therethrough and that are linearly spaced from each other.

The number of the apertures of the housing and the plate and the number of the first light sources correspond to the number of the casings. The lighting system can contain one casing, two casings or any plurality of casings as desired.

In an exemplary embodiment, the housing can include a first arm that extends in a vertical direction and a second arm that extends horizontally from the first arm. The first arm can include a recess configured to aid in mounting the lighting system to a surface and a first flange that projects therefrom to delimit an internal space of the housing at a first end thereof. The second arm, which can extend at an angle from the first arm, can extend between a first end that is contiguous to the first arm and a second end from which a second flange projects to delimit an internal space of the housing at a second end thereof.

In another exemplary embodiment, the housing can include a base, a first sidewall that extends from a first side of the base at a first angle and a second sidewall that extends from a second side of the base at a second angle that is mirror opposite the first angle.

At least one lens can be arranged within the housing and aligned with the at least one aperture of the housing and the second light source to concentrate and project light from the second light source through the lens in the downward direction. The second light source can be arranged between the at least one first light source and the at least one lens within the housing. A first rim can project into the at least one aperture of the housing to secure the lens within the housing. The housing can include an internal sidewall that extends at an outer periphery of the at least one aperture of the housing toward an internal space of the housing and a second rim can extend from the internal sidewall within the internal space of the housing.

The at least one first light source can be a first light-emitting diode (LED) that is fixable to a first circuit board. The second light source can be a second light-emitting diode (LED) that is fixable to a second circuit board.

The plate, which can be, for example, at least one of rectangular and square, can include at least one mounting ring that is arranged within the at least one aperture of the plate and that is configured to support the at least one casing. The plate can include a first surface and a second surface that is mirror opposite the first surface. The at least one mounting ring can include a main body that is contactable with the second surface of the plate and a rim that is offset inwardly from an outer periphery of the main body and configured to extend within the at least one aperture of the plate. The mounting ring can include threading extending about an internal surface thereof.

The casing can include a main body that has a base with an opening extending therethrough, a sidewall that extends in a first direction from the base and a neck that extends at an outer periphery of the opening in a second direction from the base. The main body can be configured to be at least be partially arranged within the at least one opening of the plate and seated on the plate. As noted above, the mounting ring of the plate can have threading extending about an internal surface thereof and the casing can include threading extending about an external surface thereof that is configured to mate with the threading of the mounting ring.

The casing can include an elongated body that is comprised of at least one of a transparent and an opaque material. The elongated body can be comprised of at least one of crystal, glass and a polymer. The elongated body can be tubular and have a circular cross-section. Alternatively, the elongated body can be square, rectangular, ovoid, elliptical or any other geometric shape. The elongated body can include at least one of a concave top portion and an open top portion. The elongated body can includes a cone arranged therein. The shape of the mounting ring can be configured to match the shape of the elongated body.

The lighting system can include a mounting bracket that is configured to be affixable to a surface to support the lighting system. The housing can include a recess and the mounting bracket can be configured to be releasably fixed within the recess. The mounting bracket, which can be comprised of metal, can include a base, a first flange that extends from a first end of the base of the mounting bracket in a first direction and a second flange that extends from a second end of the base of the mounting bracket in a second direction with the first flange and the second flange of the mounting bracket configured to interact with the housing and be releasably fixed thereto.

Alternatively, the lighting system can include at least one cord that is fixable to the housing to suspend the lighting system from a ceiling. At least one block can be arranged within the housing. The block can include at least one opening, recess or channel in which the cord can be positioned. The recess can extend the length of the block and allow for the cord to be slideably fixed within the recess. The cord can extend through at least one opening in the plate to a surface to suspend the light fixture from the surface. In an exemplary embodiment, the lighting system can include a first cord fixable near a first end of the housing and a second cord fixable near a second end of the housing. A first block that has an opening or recess can be arranged within the housing near the first end and a second block that has opening or recess can be arranged within the housing near a second end. The first cord can be arranged within the first recess to be slideably fixed within the first recess and the second cord can be arranged within the second recess to be slideably fixed within the second recess with the first cord extending through at least one opening in the plate adjacent the first block and the second cord extending through at least one second opening in the plate adjacent the second block.

The lighting system can include at least one cord splitter that is fastenable to the at least one cord at a first position and through which the at least one cord can extend at a second position to fix the lighting system at a desired height and angular orientation. The splitter can include a tightening mechanism, such as a set screw, that aids in fixing the cord at a desired height and angular orientation and allows for adjustment of the length of the cord and the angular orientation of the lighting system, as desired. In an exemplary embodiment, when the lighting system includes a first cord and a second cord, the lighting system can include a first cord splitter and a second cord splitter to arrange and fix the lighting system at a desired height and angular orientation.

The lighting system can comprise a power source located remote to the housing, the plate, the at least one casing, the at least one first lighting source and the second lighting source and electrically connectable to at least one of the at least one first lighting source and the second lighting source.

According to another exemplary embodiment, the present disclosure is directed to a lighting system that comprises a housing that is configured to be mountable to a surface and that includes at least aperture extending therethrough, at least one casing that is arranged on the housing in line with the at least one aperture of the plate, at least one light source that is arranged within the housing and configured to emit light into an internal area of the at least one casing and a second light source that is arranged within the housing and configured to emit light in a downward direction through the at least one aperture of the housing.

DETAILED DESCRIPTION OF EMBODIMENTS OF THE INVENTION

Figure 1:
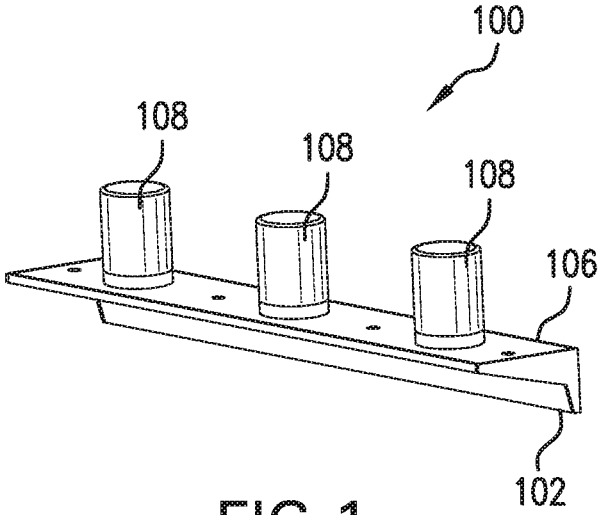
FIGS. 1 and 2 are a perspective views of a lighting system according to an exemplary embodiment of the present invention.
Figure 2:
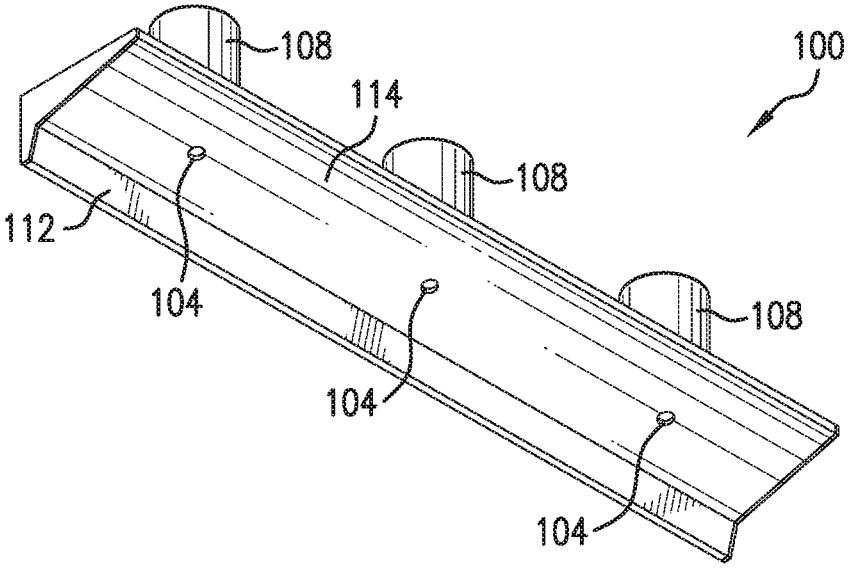
Figure 3:
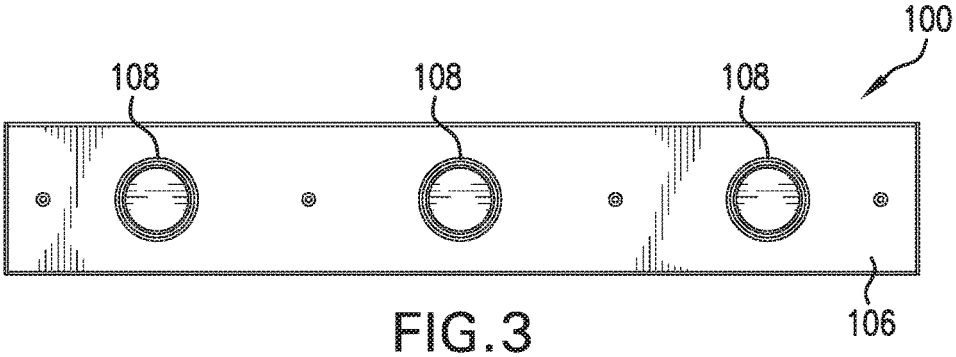
FIG. 3 is a top view of the lighting system of FIG. 1.
Figure 4:
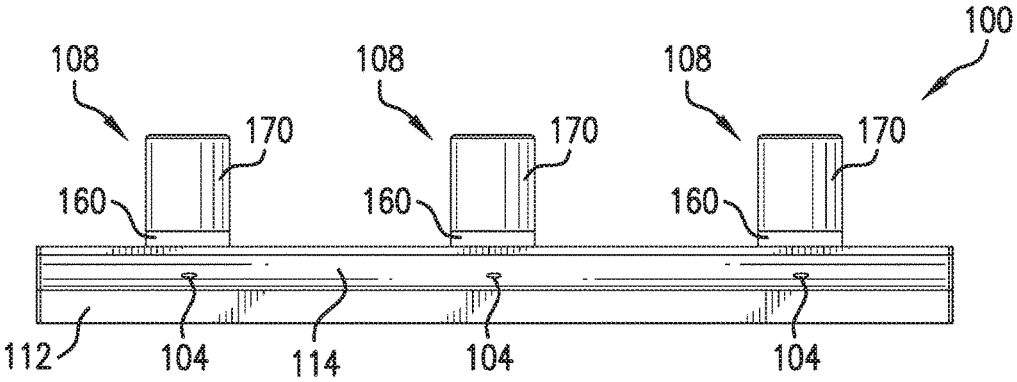
FIG. 4 is a front elevation view of the lighting system of FIG. 1.
Figure 5:
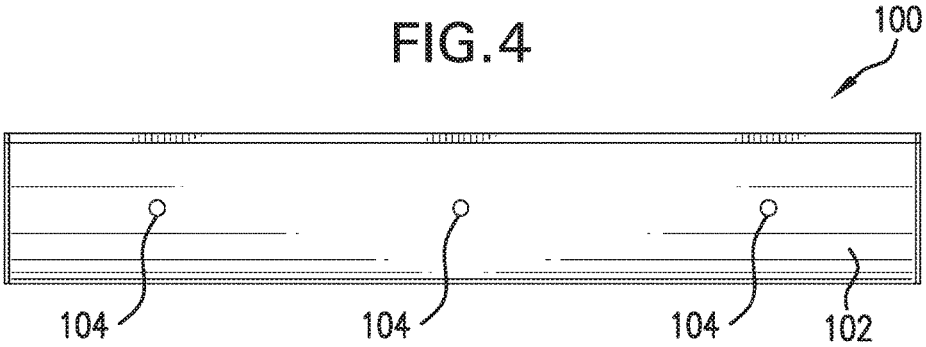
FIG. 5 is a bottom view of the lighting system of FIG. 1.
Figure 6:
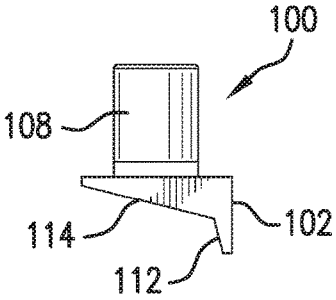
FIGS. 6 and 7 are side views of the lighting system of FIG. 1.
Figure 7:
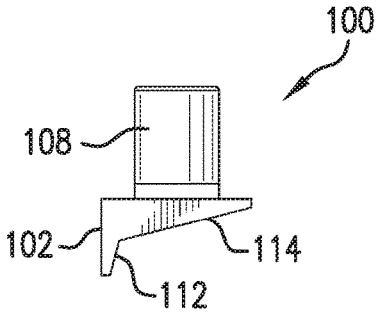

With reference now to the drawings, wherein the same reference number indicates the same element throughout, exemplary embodiments of the lighting system of the present invention will be described.

FIGS. 1-11 depict various views of an exemplary embodiment of a lighting system 100 of the present invention. As shown in FIGS. 1-7, the lighting system 100 generally includes a housing 102 that is mountable to a surface and has a plurality of apertures 104 through which light can be project in a downward direction, a plate 106 that is configured to be arranged on the housing 102 and a plurality of casings 108 through which light can be project in an upward direction and that are configured to be arranged on the plate 106.

Figure 8:
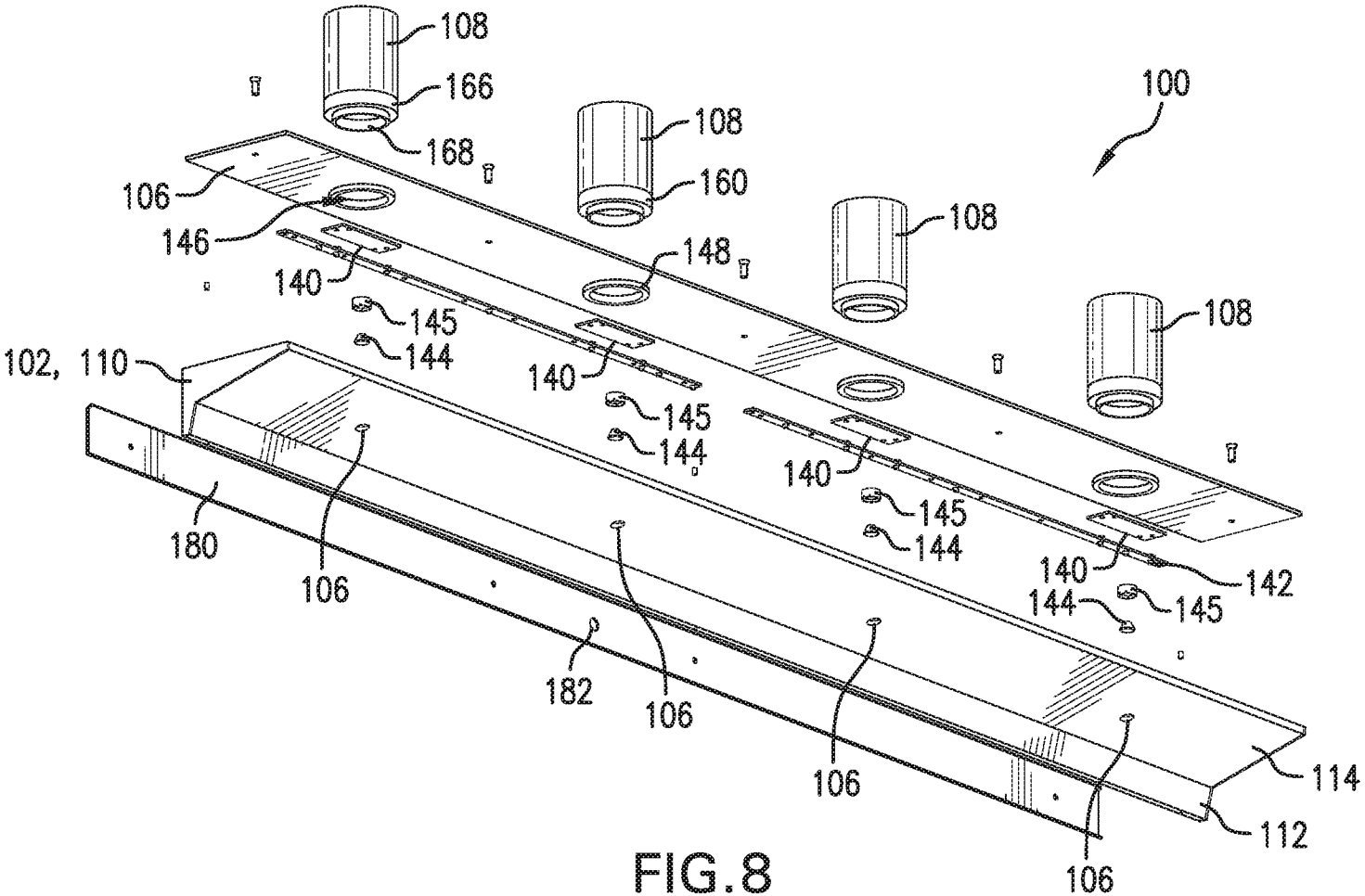
FIG. 8 is an exploded perspective view of the lighting system of FIG. 1.
Figure 9:
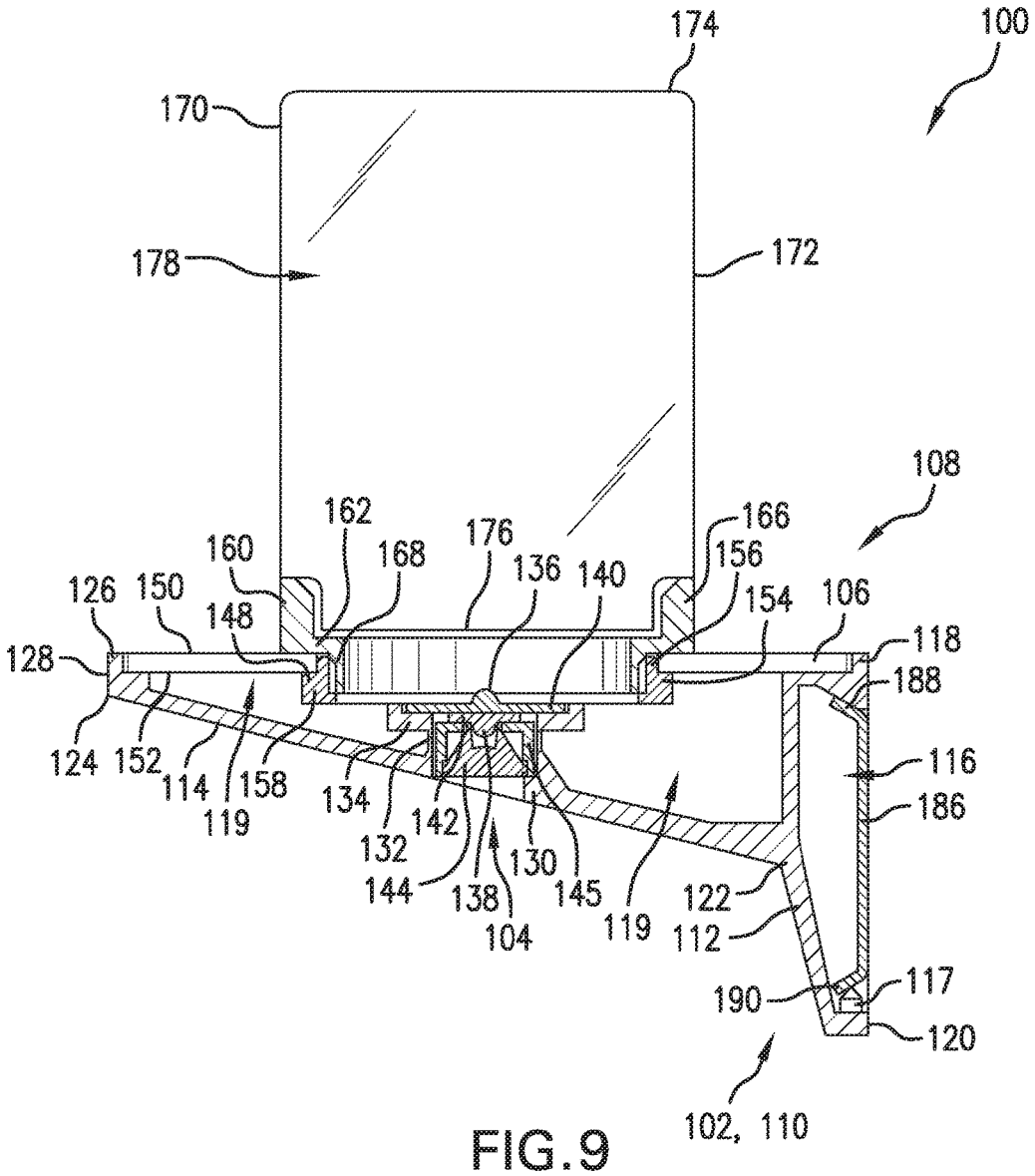
FIG. 9 is a cross-sectional view taken along line 9-9 of FIG. 4 representing a casing mounted to a base of the lighting system according to an exemplary embodiment of the present invention.

FIGS. 8 and 9 depict many of the elements of the lighting system 100 in an exploded view and cross-sectional view, respectively. As illustrated, the housing 102 includes a body 110 that has a first arm 112 that extends in a vertical direction and a second arm 114 that extends horizontally from the first arm 112. The first arm 112 includes a recess 116 that is configured to aid in mounting the lighting system 100 to a surface and a first flange 118 that projects vertically to delimit an internal space 119 of the housing 102 at a first end 120. The second arm 114 extends at an angle from the first arm 112 between a first end 122 that is contiguous to the first arm 112 and a second end 124. A second flange 126 projects at the second end 124 vertically in a same direction as the first flange 118 to delimit the internal space 119 of the housing 102 at a second end 128. Together, at least the first flange 118 and the second flange 126 form a flat, linearly extending surface for the plate 106 to be mounted on. In an embodiment, the housing 102 can be made from extruded metal. However, the housing 102 can be made from any material that may be known or become known such as a polymeric material, composite or wood. The base 102 can have a rectangular, square, triangular, or other polygonal cross-section.

As illustrated in FIG. 9, the apertures 104, which are linearly spaced and equidistant from each other, extend through the second arm 114 of the housing 102. A first rim 130 projects from an outer periphery of each of the apertures 104 of the housing 102, inwardly. An internal sidewall 132 extends at an outer periphery of each aperture 104 of the housing 102 toward the internal space 119 of the housing 102 and a second rim 134 extends from the internal sidewall 132 within the internal space 119 of the housing 102.

As can be seen in FIGS. 8 and 9, a plurality of first light sources 136 and a second light source 138 are arranged within the internal space 119 of the housing 102. The first light sources 136 are configured to project light in an upward direction into the casings 108 while the second light source 138 is configured to emit light in a downward direction through the apertures 104 in the housing 102. The light sources 136, 138 are arranged such that the first light source 136 and the second light source 138 are adjacent to each other with the first light source 136, which can be arranged on the second rim 134, positioned above the second light source 138 within the housing 102. The light sources 136, 138 can be light-emitting diodes (LED) that are arranged on a circuit board 140, 142, respectively. It is noted that although a plurality of first circuit boards 140 and a single second circuit board 142 are shown in the figures, any number of first circuit boards 140 and second circuit boards 142 can be included in the lighting system 100 and any number of first and second light sources 136, 138 can be fixed to each circuit board 140, 142.

A plurality of lenses 144, as depicted in FIGS. 8 and 9, can be arranged within a lens covering 145, the housing 102 and seated on the first rim 130 within each aperture 104 of the housing 102 to concentrate or gather the light provided by the second light source 138 and project light from the second light source 138 through each lens 144 in the downward direction. The second light source 138 can be arranged between each first light source 140 and each lens 144 within the housing.

The plate 106, as shown in FIGS. 8 and 9, which can be, for example, at least one of rectangular and square, includes at least one aperture 146 in which a respective casing 108 and a respective mounting ring 148 is arranged. The plate 106 can be secured to the housing 102 by any attachment means. For example, the plate 106 can be secured to the housing 102 by a fastener(s) such as screw(s) or nail(s), an adhesive, snap fit or press fit, etc. The plate 106 includes a first surface 150 and a second surface 152 that is mirror opposite the first surface 150 (see FIG. 9). The mounting ring 148 includes a main body 154 that is contactable with the second surface 152 of the plate 106 and a rim 156 that is offset inwardly from an outer periphery of the main body 154 and configured to extend within an aperture 146 of the plate 106. Each mounting ring 148 can include threading (not shown) extending about an internal surface 158 thereof to aid in securing a casing within an aperture 146 of the plate 106.

As shown in FIG. 9, the casing 108 includes a main body 160 that has a base 162 with an opening 164 extending threrethrough, a sidewall 166 that extends in a first direction from the base 162 and a neck 168 that extends from the base 162, at the outer periphery of the opening 164 (see FIG. 8), in a second direction. The neck 168 can include threading extending about an external surface thereof that is configured to mate with the threading of the mounting ring 148 to secure the casing 108 within an aperture 148 of the plate 106. Alternatively, the casing 108 can be seated within an aperture 148 of the plate 106, press-fit within an aperture 148 of the plate 106, fixed by a fastener, adhesive or other means within an aperture 148 of the plate 106.

As depicted in FIGS. 1-11, the casing 108 can include elongated body 170 that is attached to the main body 160 and has an outer surface 172, a top end 174, a bottom end 176 and an internal area 178. Each casing 108 can be comprised of from a translucent, opaque or semi-translucent material, such as glass, acrylic, crystal, plastic or metal.

Each casing 108 can be any desired height (e.g., 4 inches, 5 inches, 6 inches, etc.) and width (e.g., 2 inches, 3 inches, 4 inches, etc.). Although each casing 108 shown depicted in the exemplary embodiments is cylindrical, the casings 108 can take the form of any geometric shape that is known or may become known. As such, the casings 108 can be, for example, rectangular, square or oval or circular. The elongated body 170 can include at least one of a concave top portion, a sealed top portion or an open top portion. In an embodiment, the elongated body 170 can includes a cone arranged therein.

Figure 10:
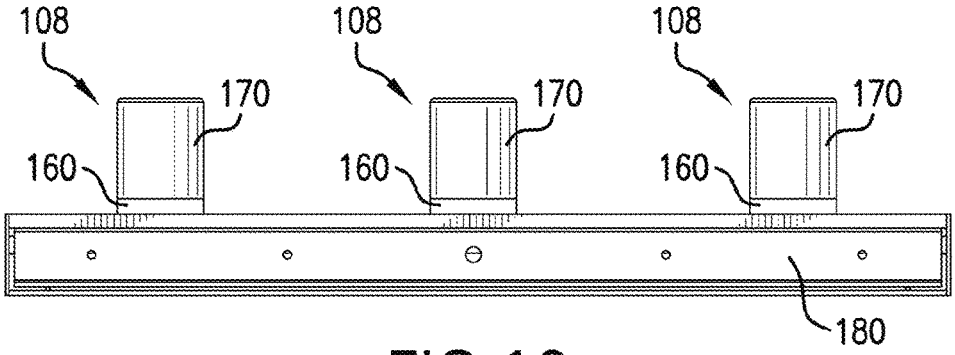
FIG. 10 is a rear view of the lighting system of FIG. 1 depicting a mounting assembly configured to secure the lighting system to a surface.
Figure 11:
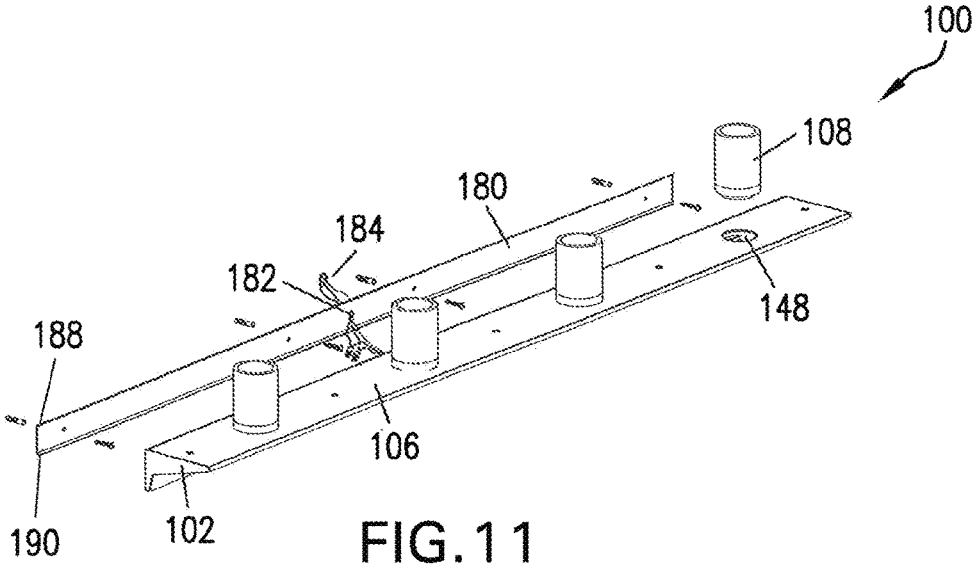
FIG. 11 is an exploded perspective view of the mounting assembly of the lighting system according to an exemplary embodiment of the present invention.

As depicted in FIGS. 9-11, the lighting system 100 may comprise a mounting bracket 180 that is affixable to a surface 181 (e.g., wall) and can be releasably affixable to the housing 102 to secure the lighting system 100 to the wall 181 or other supporting structure. It is contemplated that the mounting bracket 180 can be affixed to a surface by any means including fasteners such as screws, nails, etc. or an adhesive. The mounting bracket 180 can be comprised, for example, of a metal, alloy, composite, polymer, etc. and can include at least one opening 182 through which electrical wires 184 can pass to provide power to the lighting system 100 while keeping the power supply (not shown) hidden behind the wall 181 as discussed below.

In an embodiment as illustrated in FIGS. 9 and 11, the mounting bracket 180 includes a base 186, a first flange 188 that extends from a first end of the base 186 of the mounting bracket 180 in a first direction and a second flange 190 that extends from a second end 192 of the base 186 of the mounting bracket 180 in a second direction 192 with the first flange 188 and the second flange 190 of the mounting bracket 180 configured to interact with the housing 102 and be releasably fixed thereto. As indicated above, the housing 102 can include a recess 116 and the first flange 188 and the second flange 190 of the mounting bracket 180 can be configured to be releasably fixed within the recess 116.

As shown in an embodiment in FIG. 9, the housing 102 can include a projection 117, such as a pin that can be spring-loaded and that can extend into the recess 116 to aid in both releasably securing the mounting bracket 180 within the recess 116 and separating the housing 102 from the mounting bracket 180.

Figure 12:
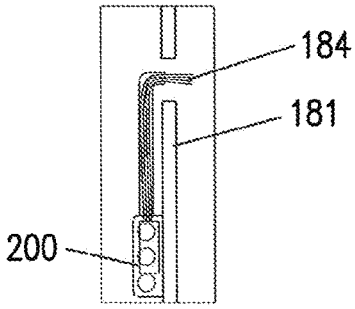
FIG. 12 is a side view of an LED driver arranged behind a wall and within close proximity to a lighting fixture according to an exemplary embodiment of the present invention.

To illuminate the lighting system 100, power runs from a transformer (not shown). Output wires 184 that extend from the transformer are then installed to a LED driver or power supply 200, which, as depicted in FIG. 12, is located remote to the housing 102, the plate 106, the casings 108, the first light sources 136 and the second light source 138, which is electrically connected to the first light sources 136 and the second light source 138 and which normalizes the power and current needed to illuminate the light sources 136, 138. Electric current travels from the power supply 200 through the wires 184 to the light sources 136, 138 that are arranged within the housing 102. The power supply 200 can be a conventional AC power supply that provides current to the light sources 136, 138. As such, the transformer can step down the line voltage from a standard power line to 12 VAC or 24 VAC.

The exemplary embodiment of the lighting system 100 of the present invention shown in FIGS. 1-11 depicts a configuration that includes four casings with elongated bodies. In the four casing configuration, the plate 106 includes four corresponding apertures 148. Separate first light sources 136 are arranged within the housing 102 to project light through the apertures 148 and into the internal area of each of the four casings 108. The second light source 142 extends about the internal area of the housing 102 and a configured to project light through corresponding lenses 144 that sits within each of the four corresponding apertures 148 of the housing 102. As such, light can be emitted in both directions along a plurality of vertical axes spaced equidistant from each other.

Although the lighting system 100 depicts a housing 102 that includes four apertures 104, a plate 106 that includes four apertures 148 and four casings 108, four first light sources 140, at least one second light source 142 and four lenses 144, the application should not be limited to the specific number of elements of the lighting system 100 depicted in FIGS. 1-11. A lighting system can include any number of apertures in a housing and a corresponding plate, any number of first and second light sources, any number of lenses and any number of casings depending on desired application. Additionally, the length of a housing, plate and circuit boards can vary depending on application and the casing(s) can exclude the elongated body.

FIGS. 13-18B depict various views of an exemplary embodiment of a lighting system 200 of the present invention. The lighting system 200, similar to the lighting system 100 described above, generally includes a housing 202 that has a plurality of apertures 204 (See FIG. 15) through which light can project in a downward direction, a plate 206 that is configured to be arranged on the housing 202 and a plurality of casings 208 through which light can be project in an upward direction that are configured to be arranged on the plate 206.

The housing 202, which can be comprised of extruded metal and as shown has a trapezoidal shape, includes a base 203, a first sidewall 205 that extends from a first side of the base 203 at a first angle and a second sidewall 207 that extends from a second side of the base 203 at a second angle that is mirror opposite the first angle. Although the housing 202 is shown as being trapezoidal, the housing 202 can take the form of any known geometric shape such as a rectangle, a triangle or square. Additionally, the housing 202 can be made from any material that is known or may become known such as plastic, a composite or wood.

Figure 14:
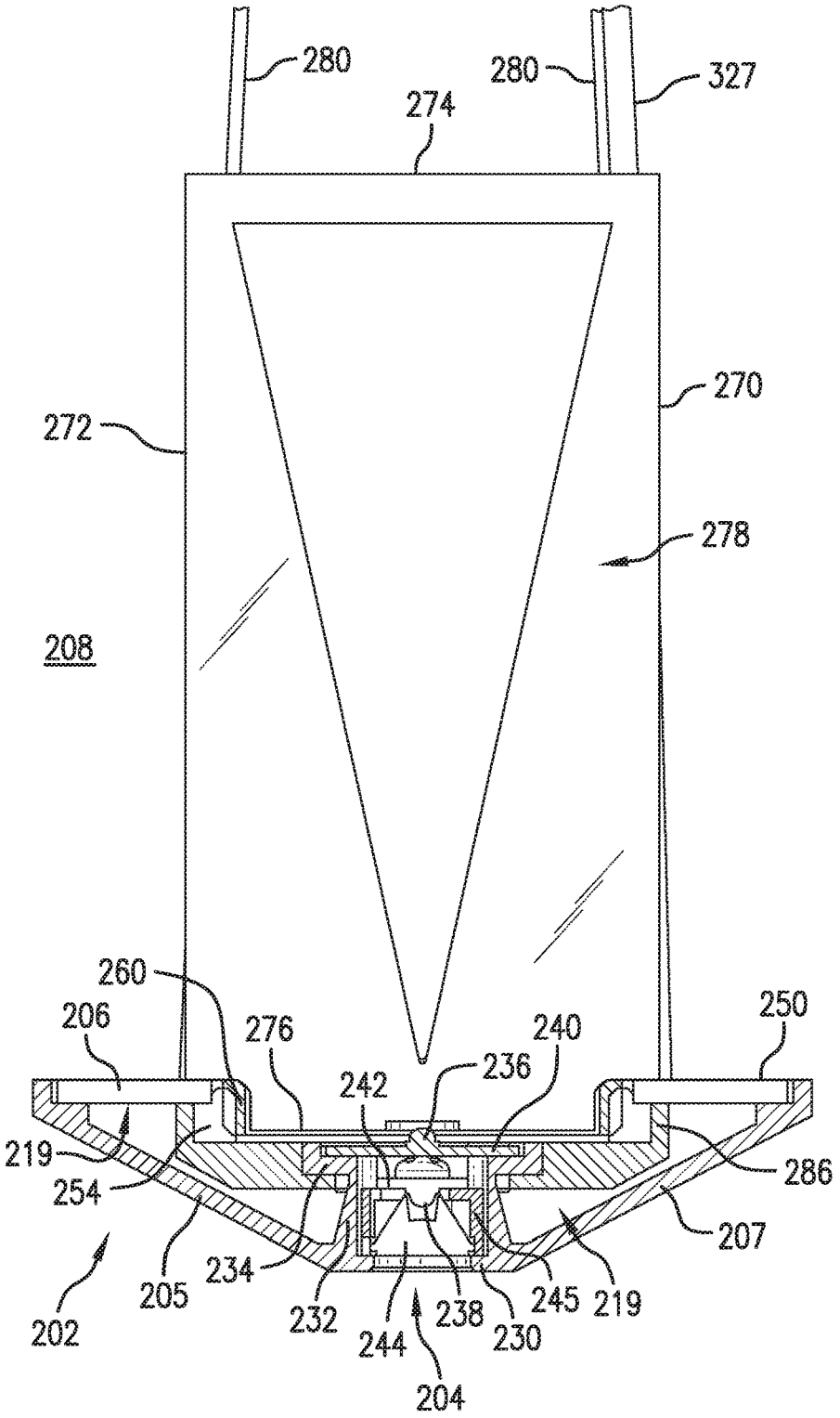
FIG. 14 is a cross-sectional view of the lighting system of FIG. 13.

As can be seen in FIG. 14, the apertures 204, which are linearly spaced and equidistant from each other, extend through the base 203 of the housing 202. A first rim 230 projects from an outer periphery of each of the apertures 204 of the housing 202, inwardly. An internal sidewall 232 extends at an outer periphery of each aperture 204 of the housing 202 toward the internal space 219 of the housing 202 and a second rim 234 extends from the internal sidewall 232 within the internal space 219 of the housing 202.

Figure 15:
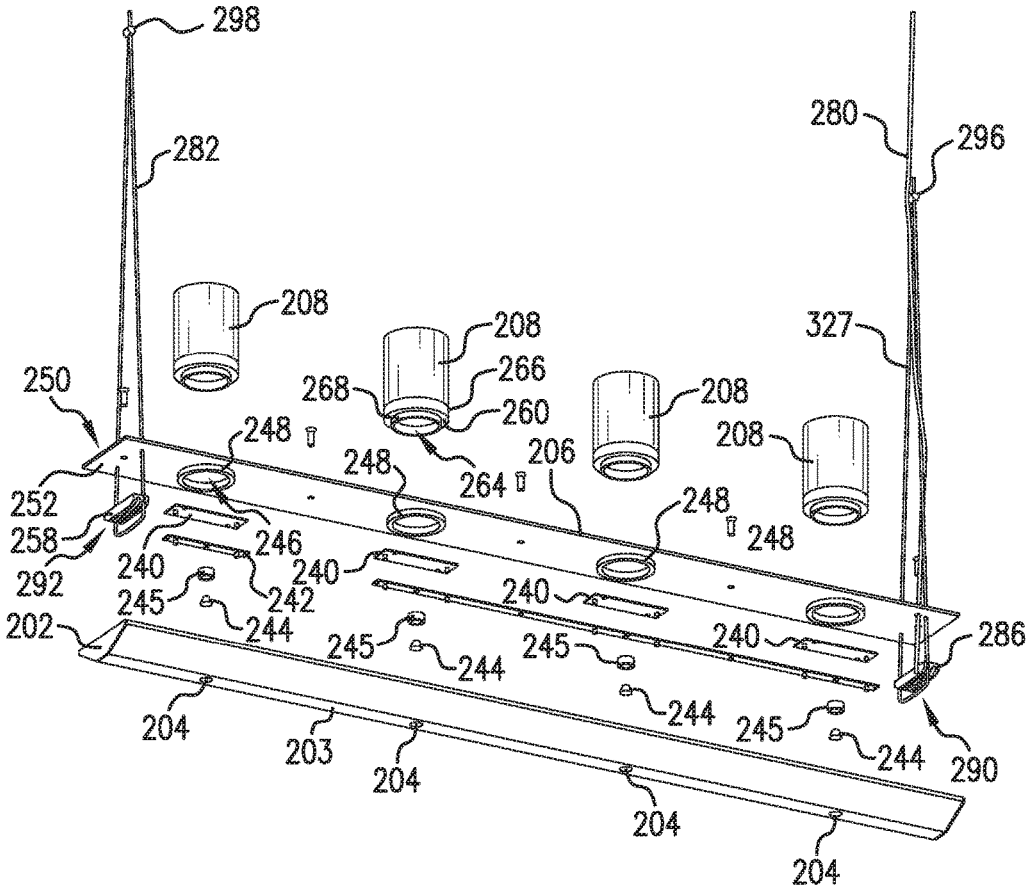
FIG. 15 is an exploded view of the lighting system of FIG. 13.

As can be seen in FIGS. 14 and 15, a plurality of first light sources 236 and a plurality of second light source 238 are arranged within the internal space 219 of the housing 202. The first light sources 236 are configured to project light in an upward direction into the casings 208 while the second light source 238 is configured to project light in a downward direction through the apertures 204 in the housing 202. The light sources 236, 238 are arranged such that the first light source 236 and the second light source 738 are adjacent to each other with the first light source 236, which can be arranged on the second rim 234, positioned above the second light source 238 within the housing 202. The light sources 236, 238 can be light-emitting diodes (LED) that are arranged on circuit boards 240, 242, respectively. It is noted that although a plurality of light sources 236, 238 and a plurality of associated circuit boards 240, 242, respectively, are shown in the figures, a single first circuit board 240 can exist that contains a single or a plurality of first light sources 236 fixed thereto and similarly a single second circuit board 240 can exist that contains a single or a plurality of second light sources 236 fixed thereto. As such, the number of circuit boards 240, 242 and the number of light sources 236, 238 fixed thereto can vary.

A plurality of lenses 244 can be arranged within a lens covering 245 the housing 202 and seated on the first rim 230 within each aperture 204 of the housing 202 to concentrate or gather the light provided by the second light source 238 and project light from the second light source 238 through each lens 244 in the downward direction. The second light source 242 can be arranged between each first light source 240 and each lens 244 within the housing 202.

The plate 206, which can be, for example, at least one of rectangular and square, includes at least one aperture 246 in which a respective casing 208 and a respective mounting ring 248 is arranged. The plate 206 can be secured to the housing 202 by any attachment means. For example, a fastener(s) such as a screw(s), nail(s), adhesive, snap fit or press fit, etc. The plate 206 includes a first surface 250 and a second surface 252 that is mirror opposite the first surface 250. The mounting ring 248 includes a main body 254 that is contactable with the second surface 252 of the plate 206 and a rim 756 that is offset inwardly from an outer periphery of the main body 254 and configured to extend within an aperture 246 of the plate 206. Each mounting ring 248 can include threading (not shown) extending about an internal surface 258 thereof to aid in securing a casing within an aperture 246 of the plate 206.

As shown, the casing 208 includes a main body 260 that has a base 262 with an opening 264 extending threrethrough, a sidewall 266 that extends in a first direction from the base 262 and a neck 268 that extends from the base 262, at the outer periphery of the opening 264, in a second direction.

The neck 268 can include threading extending about an external surface thereof that is configured to mate with the threading of the mounting ring 248 to secure the casing 208 within an aperture 246 of the plate 206. Alternatively, the casing 208 can be seated within an aperture 248 of the plate 206, press-fit within an aperture 246 of the plate 206, fixed by a fastener, adhesive or other means within an aperture 246 of the plate 206.

The casing 208 can include elongated body 270 that is attached to the main body 260 and has an outer surface 272, a top end 274, a bottom end 276 and an internal area 278. Each casing 208 can be comprised of from a translucent, opaque or semi-translucent material, such as glass, acrylic, crystal, plastic or metal.

Each casing 208 can be any desired height (e.g., 4 inches, 5 inches, 6 inches, etc.) and width (e.g., 2 inches, 3 inches, 4 inches, etc.). Although each casing 208 shown depicted in the exemplary embodiments is cylindrical, the casings 208 can take the form of any geometric shape that is known or may become known. As such, the casings 208 can be, for example, rectangular, square or oval or circular. The elongated body 270 can include at least one of a concave top portion, a sealed top portion or an open top portion. In an embodiment, the elongated body 270 can includes a cone arranged therein.

To suspend the lighting system 200 from a ceiling or other structure or surface, the lighting system 200 can include at least one cord that is fixable to the housing 202. As shown, for example, in FIGS. 13 and 15, the lighting system 200 includes a first cord 280 that is delimited at a first end and a second end and that is fixable near a first end of the housing 202 and a second cord 282 that is delimited at a first end and a second end and that is fixable near a second end of the housing 202 to aid in suspending the lighting system 200 from a surface. The first cord 280 includes a first stop 221 (see FIG. 17) affixed to the second end of the cord 280 and the second cord 782 includes a second stop (not shown) affixed to the second end of the cord 282.

Figure 16:
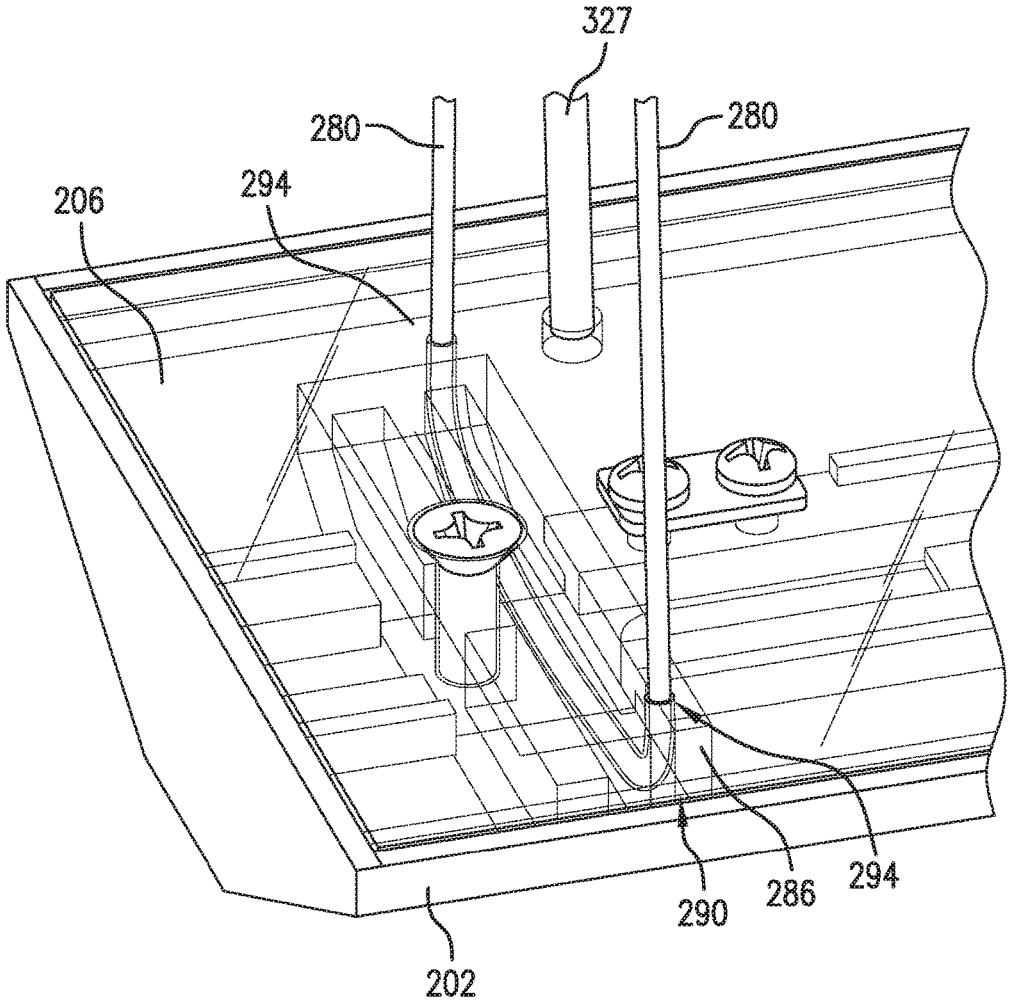
FIG. 16 is a partial perspective view of the lighting system of FIG. 13.

As illustrated in FIGS. 15 and 16, each cord 780, 782 is associated with a block that is arranged within the housing 202. Here, the first cord 280 is associated with a first block 286 and the second cord 282 is associated with a second block 288. The blocks 286, 288 include at least one opening, recess or channel 290, 292, respectively in which the respective cord 280, 282 can be positioned. The recess 290, 292 extends the length of the block 286, 288 and allows for the cord 280, 282 to be slideably fixed within the recess 290, 292 to allow for adjustability of the lighting fixture 200. The cord 280, 282 can extend external of the housing 202 and the plate 206 through openings 294 in the plate 206 to suspend the light fixture 200 from a surface.

To aid in fixing the lighting system 200 at a desired height and angular orientation, the lighting system 200 includes a first splitter 296 associated with the first cord 280 and a second splitter 298 associated with the second cord 282. Each splitter 296, 298 is fastenable to the respective cord 280, 282 at a first position and through which the cord 280, 282 can extend and at a second position to fix the lighting system 200 at a desired height and angular orientation.

Figure 17:
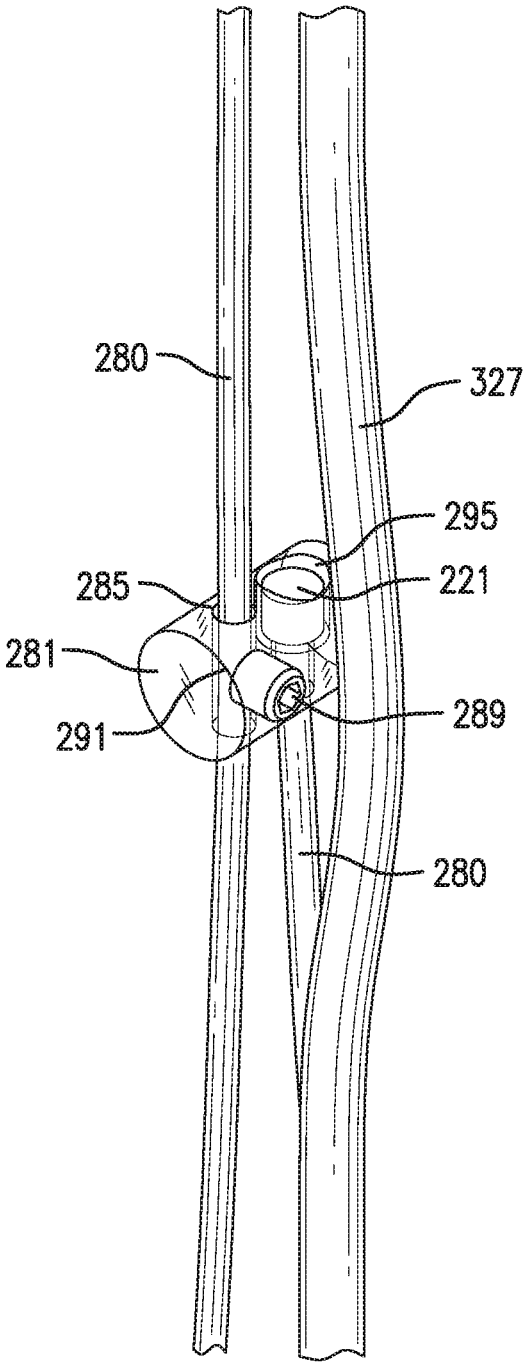
FIG. 17 is a perspective view of a gripper included in the lighting system of FIG. 13 to secure the cord at a desired position.
Figure 18A:
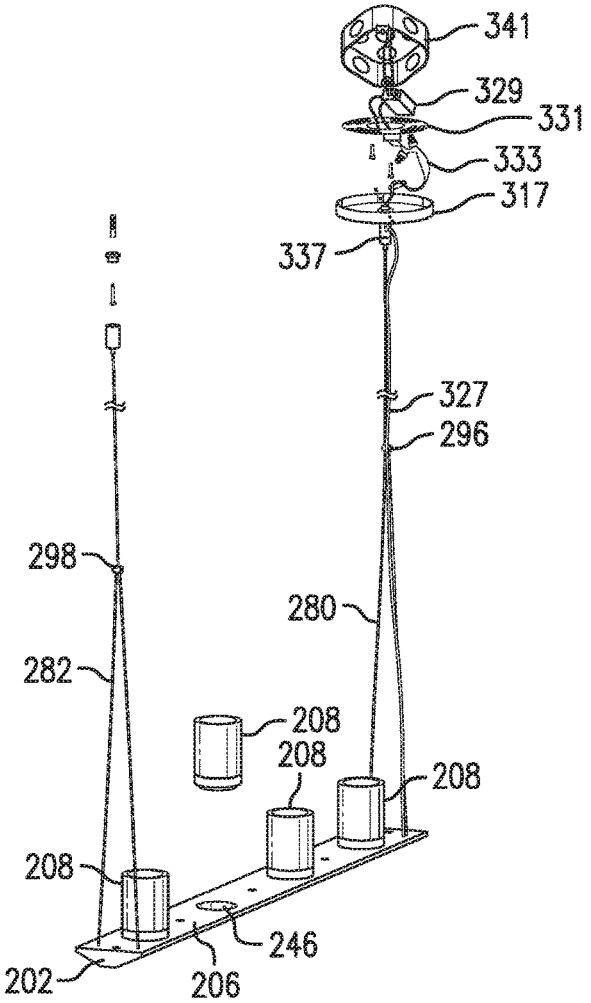
FIG. 18A is a perspective partially exploded view of the lighting system of FIG. 13.
Figure 18B:
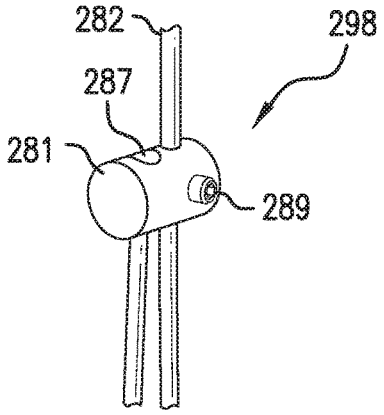
FIG. 18B is a detail view of a gripper assembly from FIG. 18A.
Figure 19:
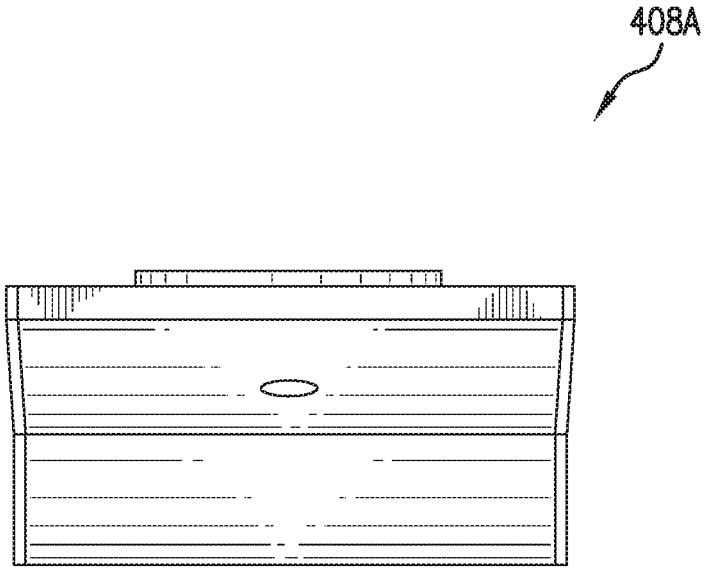
FIGS. 19-23 are front elevational views of various casings that can be mounted on a lighting system according to exemplary embodiments of the present invention.
Figure 20:
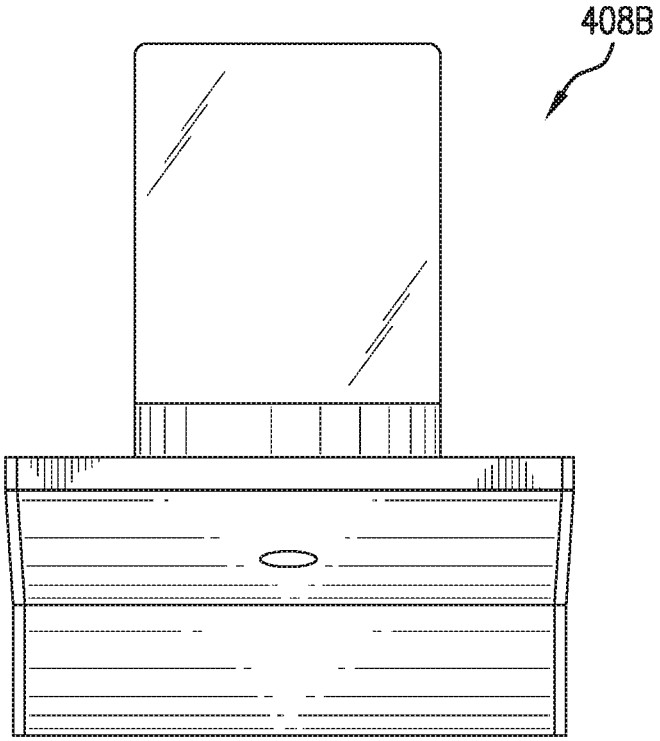
Figure 21:
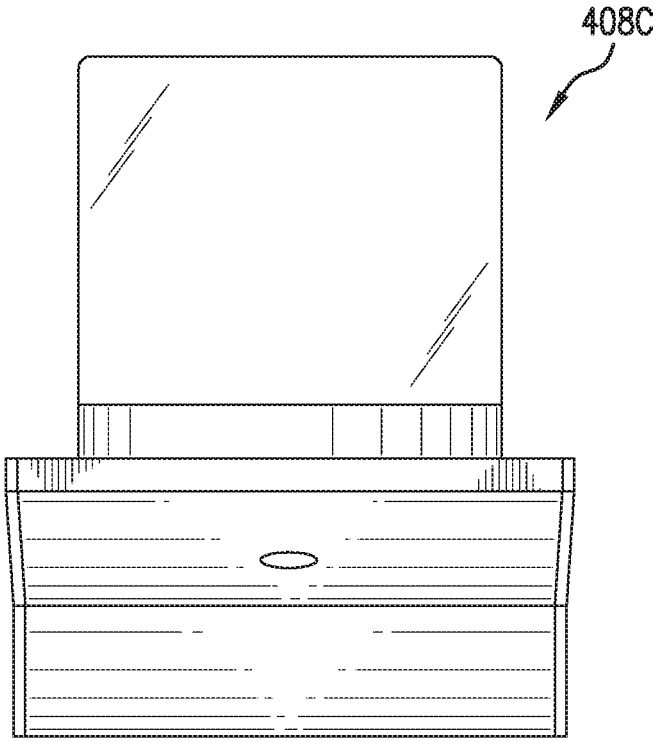
Figure 22:
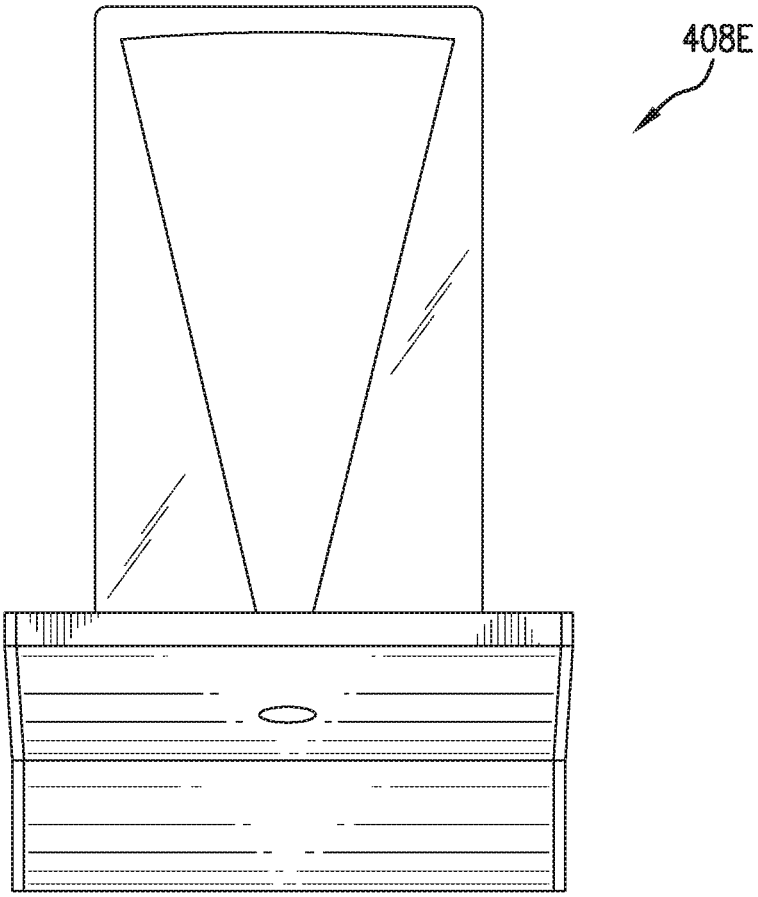
Figure 23:
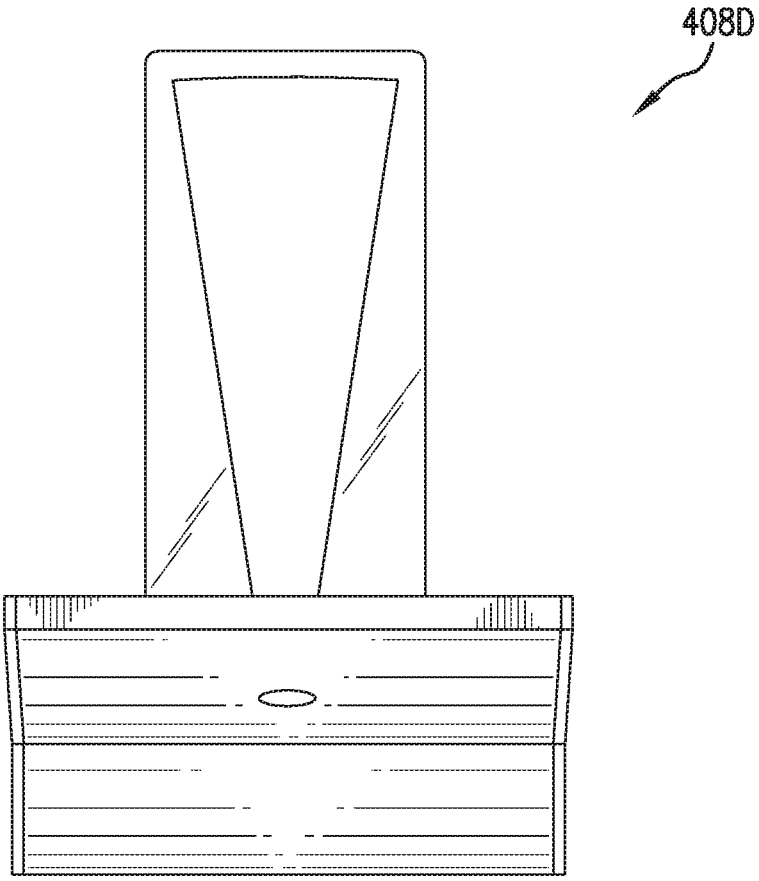

As shown in FIGS. 17 and 18B, the cord splitters 296, 298 each include a body 281, 283, a first hole 285, 287, a second hole 291 that extends transverse to the first hole 281, 283 and a third hole 295, 297 that extends substantially parallel to the first hole 285, 287, respectively. It is noted that the details of the second cord splitter 298 depicted in FIG. 18B are identical of those of the first splitter 296 depicted in detail in FIG. 17.

A fastener or tightening mechanism 289, such as a set screw, can be arranged in the second holes 291 to aid in fixing the cords 280, 282 at a desired height and angular orientation and allows for adjustment of the length of the cords 280, 282 and the angular orientation of the lighting system 200, as desired. The first stop 221 at the second end of the first cord 280 can be arranged in the third hole 295, 297 to fix the second end of the cord 280 within the splitter 796 and second stop (not shown) at the second end of the second cord 282 can be arranged in the third hole (not shown) of the second splitter 298 to fix the second end of the cord 282 within the splitter 298.

As shown in FIG. 17, the first end of the first cord 280 is fixable to a mounting post 215 which in turn is fixable to a surface and the first end of the second cord 282 is fixable to a canopy 317.

The lighting system 200 can be powered by a conventional AC power supply that provides current to the first and second light sources 236, 238. Electric current travels from the power supply above the ceiling or within the light system 200 to a power cord 327. The power cord 327 extends from the canopy 317 through the top plate 206 and into the housing 202.

In the installation of the lighting system 200 power runs from a transformer (not shown). The transformer steps down the line voltage from a standard power line to 12 VAC or 24 VAC. Output wires that extend from the transformer are then installed to a LED driver 329, which normalizes the power and current needed to power the LED boards 240, 242. The LED driver 829 is installed in a remote and accessible location near the lighting system 200, preferably above the ceiling near the canopy 317. A mounting plate 331 is secured to the ceiling. Output wires 333 of the LED driver 329 are fed through the mounting plate 331 and an opening in the ceiling and are electrically connected to the power cable 327. The power cable 327 is electrically connected to the first light source 236 and second light source 238 to provide power to them and allow the light sources 236, 238 to illuminate.

To assemble the lighting system 700, the height of the first splitter 296 is adjusted by loosening the fastener or tightening mechanism 289 and sliding the first splitter 296 up or down as desired. The power cord 327 and the first cable 280 are fed through a cord/cable bushing 337 and the first cable 840 is adjusted to the desired height. To shorten first cable 340, first cable 840 can be pushed into the bushing 337. To lengthen the first cable 340, the plunger can be depressed while pulling down the first cable 340 and releasing the plunger to lock it in place. Extra cable 340 can be stored in the canopy 317. The live wire of the LED driver 329 is connected to a live outlet box 341. A neutral wire of the LED driver 329 is connected to the neutral wire of the outlet box 341. A ground wire is connected to the ground wire of the outlet box 841. If no ground is present in the outlet box 341, the neutral wire can be connected to the mounting plate 331. All connections and the LED driver 329 are placed in the outlet box 341. The mounting plate 331 is then attached to the outlet box 341. To shorten or extend the second cable 342, push the second cable 342 can be pulled in an upward direction. To lengthen the second cable 342, the plunger can be depressed while pulling down on the second cable 342 and when a desired position is reached, the plunger can be released to lock the second cable 342.

Figure 13:
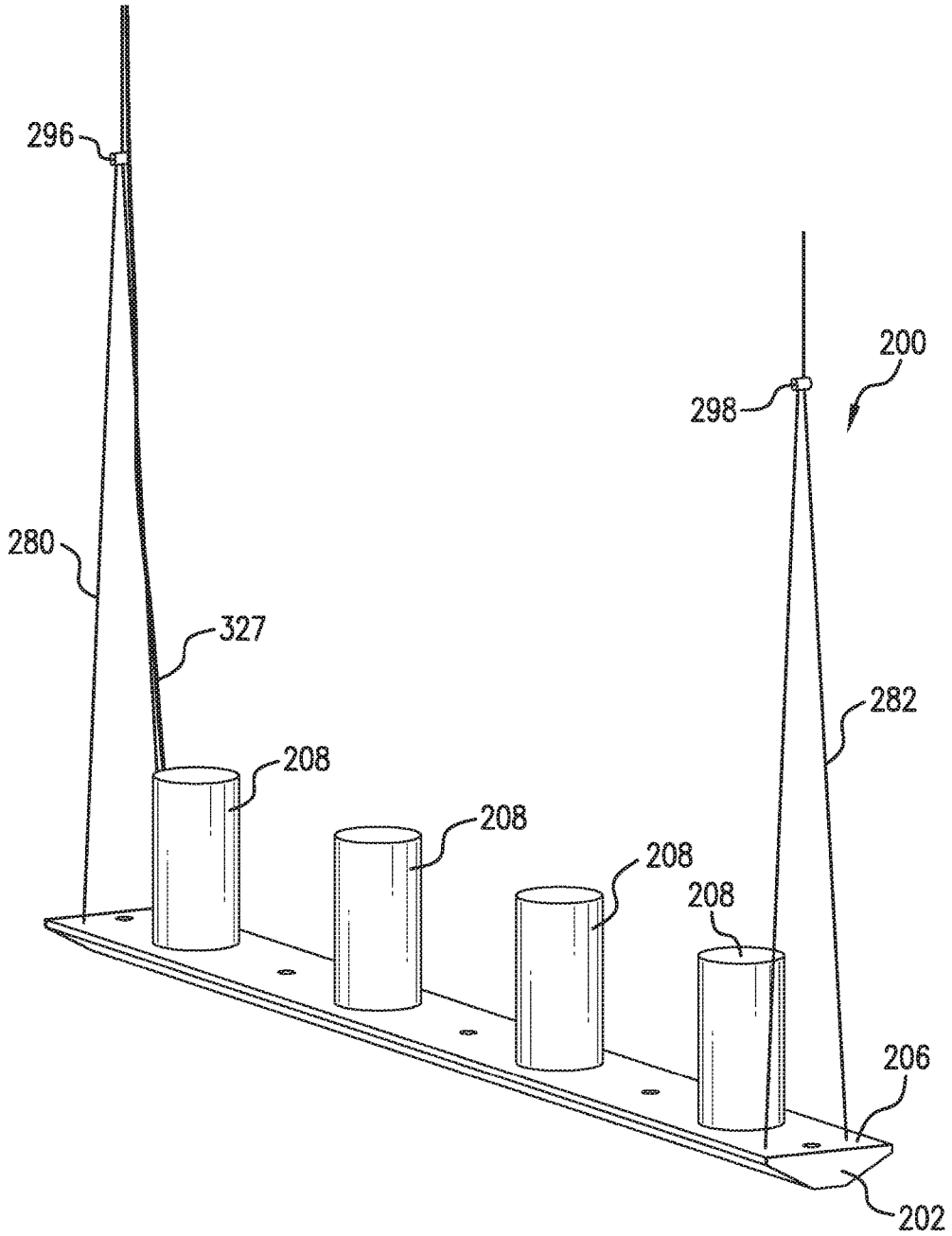
FIG. 13 is a perspective view of a lighting system according to an exemplary embodiment of the present invention.

The exemplary embodiment of the lighting system 200 of the present invention shown in FIGS. 13-15 depicts a configuration that includes four casings with elongated bodies. In the four casing configuration, the plate 206 includes four corresponding apertures 248. Separate first light sources 236 are arranged within the housing 202 to project light through the apertures 248 and into the internal area of each of the four casings 208. The second light sources 242 extend about the internal area of the housing 202 and a configured to project light through corresponding lenses 244 that sits within each of the four corresponding apertures 248 of the housing 202. As such, light can be emitted in both directions along a plurality of vertical axes spaced equidistant from each other.

As discussed above, although the lighting system 200 depicts a housing 202 that includes four apertures 204, a plate 206 that includes four apertures 248 and four casings 208, four first light sources 240, at least one second light source 242 and four lenses 244, the application should not be limited to the specific number of elements of the lighting system 200 depicted in FIGS. 13-15. A lighting system can include any number of apertures in a housing and a plate, any number of first and second light sources, any number of lenses and any number of casings depending on desired application. As such, it is contemplated that the plates and corresponding housings can have varying lengths and widths.

FIGS. 19-23 depict various embodiments of casings 408A, 408B, 408C, 408D, 408E, respectively, which can be included with either lighting system 100 or 200. The type of casing(s) included in a lighting system can be the same or can include a combination of various styles of casings 408A through 408E depending on the application. It is noted that although the casings 408A through 408E are shown as being associated with one of the exemplary embodied lighting systems 100, the casings 408A through 408E can also be used with the other exemplary embodied lighting systems 200.

Although this invention has been disclosed in the context of certain embodiments and examples, it will be understood by those skilled in the art that the invention extends beyond the specifically disclosed embodiments to other alternative embodiments and/or uses of the invention and obvious modifications and equivalents thereof. It is to be understood that the phraseology or terminology employed herein is for the purpose of description and not of limitation. In addition, while several variations of the embodiments of the invention have been shown and described in detail, other modifications, which are within the scope of this invention, including, but not limited to, the substitutions of equivalent features, materials, or parts, will be readily apparent to those of skill in the art based upon this disclosure without departing from the spirit and scope of the invention.

What is claim is:

1. A lighting system, comprising:

a housing that is mountable to a surface and includes at least one aperture extending therethrough;

a plate including at least one aperture extending therethrough that is attachable to the housing;

at least one casing that is configured to contact the plate and encompass the at least one aperture of the plate;

at least one first light source that is arranged within the housing and configured to emit light in an upward direction through the at least one aperture of the plate and into an internal area of the at least one casing; and at least one second light source that is arranged within the housing and configured to emit light in a downward direction through the at least one aperture of the housing.

2. The lighting system of claim 1, wherein the housing includes a plurality of apertures extending therethrough that are linearly spaced from each other.

3. The lighting system of claim 1, wherein the plate includes a plurality of apertures extending therethrough that are linearly spaced from each other.

4. The lighting system of claim 1, wherein the housing includes a first arm extending in a vertical direction and a second arm extending horizontally from the first arm.

5. The lighting system of claim 4, wherein the second arm of the housing extends at an angle from the first arm.

6. The lighting system of claim 4, wherein the first arm includes a recess configured to aid in mounting the lighting system to a surface.

7. The lighting system of claim 4, wherein the first arm includes a first flange that projects therefrom to delimit an internal space of the housing at a first end thereof.

8. The lighting system of claim 4, wherein the second arm extends between a first end that is contiguous to the first arm and a second end from which a second flange projects to delimit an internal space of the housing at a second end thereof.

9. The lighting system of claim 1, further comprising at least one lens that is arranged within the housing and that is aligned with the at least one aperture of the housing and the at least one second light source to concentrate and project light from the at least one second light source therethrough in the downward direction.

10. The lighting system of claim 9, wherein the at least one second light source is arranged between the at least one first light source and the at least one lens within the housing.

11. The lighting system of claim 9, further comprising a rim that projects into the at least one aperture of the housing to secure the lens within the housing.

12. The lighting system of claim 1, wherein the housing includes an internal sidewall that extends at an outer periphery of the at least one aperture of the housing toward an internal space of the housing.

13. The lighting system of claim 12, wherein a rim extends from the internal sidewall within the internal space of the housing.

14. The lighting system of claim 1, wherein the at least one first light source is a first light-emitting diode.

15. The lighting system of claim 1, wherein the at least one second light source is a second light-emitting diode.

16. The lighting system of claim 14, wherein the first light-emitting diode is fixed to a first circuit board.

17. The lighting system of claim 15, wherein the second light emitting diode is fixed to a second circuit board.

18. The lighting system of claim 1, wherein the plate includes at least one mounting ring that is arranged within the at least one aperture of the plate and configured to support the at least one casing.

19. The lighting system of claim 18, wherein the plate includes a first surface and a second surface that is mirror opposite the first surface and the at least one mounting ring includes a main body that is contactable with the second surface of the plate and a rim that is offset inwardly from an outer periphery of the main body and configured to extend within the at least one aperture of the plate.

20. The lighting system of claim 18, wherein the mounting ring includes threading extending about an internal surface thereof.

21. The lighting system of claim 1, wherein the plate is at least one of rectangular.

22. The lighting system of claim 1, further comprising a mounting bracket that is configured to be affixable to the surface to support the lighting system.

23. The lighting system of claim 22, wherein the housing includes a recess and the mounting bracket is configured to be releasably fixed within the recess.

24. The lighting system of claim 23, wherein the mounting bracket includes a base, a first flange that extends from a first end of the base of the mounting bracket in a first direction and a second flange that extends from a second end of the base of the mounting bracket in a second direction with the first flange and the second flange of the mounting bracket configured to interact with the housing and be releasably fixed thereto.

25. The lighting system of claim 1, wherein the plate is comprised of metal.

26. The lighting system of claim 1, further comprising a power source located remote to the housing and electrically connectable to at least one of the at least one first light source and the at least one second light source.

27. The lighting system of claim 1, wherein the at least one casing includes a main body having a base with an opening extending therethrough and a sidewall that extends in a first direction from the base.

28. The lighting system of claim 27, wherein the main body is configured to be at least partially arranged within the at least one opening of the plate and seated on the plate.

29. The lighting system of claim 1, wherein the plate includes a mounting ring that is arranged within the at least one aperture of the plate and that has threading extending about an internal surface thereof and the at least one casing includes threading extending about an external surface thereof that is configured to mate with the threading of the mounting ring.

30. The lighting system of claim 1, wherein the at least one casing includes a main body having a base with an opening extending therethrough, a sidewall that extends in a first direction from the base and a neck that includes threading extending about an external surface thereof and that extends at an outer periphery of the opening in a second direction from the base.

31. The lighting system of claim 1, wherein the at least one casing includes an elongated body that is comprised of at least one of a transparent and opaque material.

32. The lighting system of claim 31, wherein the elongated body is comprised of at least one of crystal, glass and a polymer.

33. The lighting system of claim 31, wherein the elongated body includes at least one of a concave top portion and an open top portion.

34. The lighting system of claim 31, wherein the elongated body includes a cone arranged therein.

35. The lighting system of claim 1, wherein the number of the apertures of the housing, the number of the apertures of the plate and the number of the first light sources correspond to the number of the casings.

36. The lighting system of claim 1, wherein the at least one casing is tubular and has a circular cross-section.

37. The lighting system of claim 1, wherein the housing includes a base, a first sidewall that extends from a first side of the base at a first angle and a second sidewall that extends from a second side of the base at a second angle that is mirror opposite the first angle.

38. The lighting system of claim 1, further comprising at least one cord that is attached to the housing to suspend and support the lighting system.

39. The lighting system of claim 38, further comprising at least one block that is arranged within the housing and through which the at least one cord interacts to aid in adjusting and supporting the lighting system.

40. The lighting system of claim 1, further comprising an adjustable suspension system.

41. The lighting system of claim 40, wherein the adjustable suspension system includes at least one cord splitter that is fastenable to at least one cord at a first position and a second position to fix the lighting system at a height and angular orientation.

42. The lighting system of claim 41, wherein the at least one cord splitter includes a tightening mechanism to fix the at least one cord.

* * * * *